US012135133B2

(12) United States Patent
Funk et al.

(10) Patent No.: US 12,135,133 B2
(45) Date of Patent: Nov. 5, 2024

(54) OVEN MUFFLE HAVING RACK-SUPPORT EMBOSSMENTS AT A LOWER POSITION AND ASSOCIATED STRUCTURAL FEATURES

(71) Applicant: Electrolux Home Products, Inc., Charlotte, NC (US)

(72) Inventors: Greg Funk, Nashville, TN (US); Mikel Woodall, Springfield, TN (US); Robert W. Smith, Springfield, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 769 days.

(21) Appl. No.: 17/114,140

(22) Filed: Dec. 7, 2020

(65) Prior Publication Data

US 2022/0178551 A1 Jun. 9, 2022

(51) Int. Cl.
*F24C 15/16* (2006.01)
*F24C 15/08* (2006.01)

(52) U.S. Cl.
CPC ..... *F24C 15/16* (2013.01); *F24C 15/08* (2013.01)

(58) Field of Classification Search
CPC ..... F24C 15/16; F24C 15/08
USPC ..... 126/25 R, 273, 19 R, 337 R
See application file for complete search history.

(56) References Cited

U.S. PATENT DOCUMENTS 2,101,582 A 12/1937 Hoff
2,539,060 A 1/1951 Cook et al.
3,145,289 A 8/1964 Swetlitz
3,151,608 A 10/1964 Hurko
3,344,779 A 10/1967 Johnson
3,590,801 A 7/1971 Long
3,624,741 A 11/1971 Dills
4,194,495 A 3/1980 Scherer
4,455,467 A * 6/1984 Dills ..... F24C 15/16 219/732
4,597,374 A 7/1986 Igarashi
6,938,617 B2 9/2005 Le et al.
6,945,245 B1 9/2005 Wilson
7,954,485 B2 6/2011 Cadima et al.
8,047,199 B2 11/2011 Le et al.
(Continued)

FOREIGN PATENT DOCUMENTS

DE 10314590 10/2004
DE 102005041576 4/2007
(Continued)

OTHER PUBLICATIONS

Range—Oven Capacity Measurement. https://products.geappliances.com/appliance/gea-support-search-content?contentid=22273. 2 pages. Last accessed Dec. 7, 2020.

*Primary Examiner* — Vivek K Shirsat
(74) *Attorney, Agent, or Firm* — Pearne & Gordon LLP

(57) ABSTRACT

An oven muffle is provided with a cavity wrapper disposed between and connected to each of a bottom cap and a top cap. A lower rack-support embossment is formed on a peripheral skirt of the bottom cap, and at a position vertically below a seam where the cavity wrapper and the bottom cap are joined. The peripheral skirt can have first and second curved sections with a linear section disposed therebetween, when viewed in cross-section. The lower rack-support embossment has embossed features, each having a respective contour that is or converges to tangent to the linear section of the peripheral skirt.

19 Claims, 9 Drawing Sheets

(56) References Cited

U.S. PATENT DOCUMENTS

| | | | | |
|---|---|---|---|---|
| 8,629,376 | B2 | 1/2014 | Palla et al. | |
| 8,826,898 | B2 | 9/2014 | Armstrong et al. | |
| 9,109,804 | B2 | 8/2015 | Armstrong | |
| 9,395,088 | B2 | 7/2016 | Wiggins et al. | |
| 2010/0218755 | A1 | 9/2010 | Stewart et al. | |
| 2012/0017885 | A1 | 1/2012 | Stewart et al. | |
| 2014/0231421 | A1 | 8/2014 | Yang et al. | |
| 2014/0283814 | A1 | 9/2014 | Armstrong | |
| 2015/0047623 | A1* | 2/2015 | Wiggins | F24C 15/08 29/458 |
| 2020/0166221 | A1 | 5/2020 | Kubtan et al. | |
| 2020/0224883 | A1* | 7/2020 | Kim | F24C 7/087 |

FOREIGN PATENT DOCUMENTS

| | | |
|---|---|---|
| DE | 102006004384 | 8/2007 |
| EP | 2520866 | 11/2012 |

* cited by examiner

OVEN MUFFLE HAVING RACK-SUPPORT EMBOSSMENTS AT A LOWER POSITION AND ASSOCIATED STRUCTURAL FEATURES

FIELD OF THE INVENTION

This application relates generally to an oven appliance having a muffle that defines a cooking chamber and, more specifically, to a lower rack-support embossment formed on a bottom cap of the muffle, and below a weld seam between the bottom cap and a cavity wrapper of the muffle. Various features formed as bends in the lower rack-support (e.g. a lower rack-support embossment) are formed having common tangents along a stress-buffer zone of the bottom cap in order to enhance manufacturability.

BACKGROUND OF THE INVENTION

Conventional oven appliances include a muffle disposed within an outer body of the appliance and secured to structural elements thereof. The muffle typically includes top and bottom caps and a C-shaped cavity wrapper, all of which collectively define a cooking chamber therein. Rack-support embossments are typically formed on opposing side walls of the C-shaped cavity wrapper in order to support cooking racks within the cooking chamber at desired heights. Due to manufacturing constraints, the lowest of those embossments are conventionally spaced a minimum distance above the bottom edge of the C-shaped cavity wrapper, where it is joined to the bottom cap at a weld seam. As a result, a cooking rack resting on the lower-most embossments results in that rack being at a relatively high position within the cooking chamber, leaving a substantial amount of unused volume beneath it.

BRIEF SUMMARY

In accordance with one aspect, there is provided an oven muffle including a cavity wrapper jointed to a bottom cap at a seam and together therewith at least partially defining a cooking chamber having a front opening. A lower rack-support embossment is formed in the bottom cap below the seam and is configured to removably support a cooking rack thereon within the cooking chamber. The lower rack-support embossment includes a front-support portion and a shelf portion spaced depthwise from one another.

In accordance with another aspect, there is provided an oven muffle including a cavity wrapper having a rear wall and opposing side walls. A bottom cap includes a bottom wall and a peripheral skirt extending away from the bottom wall. The cavity wrapper and the bottom cap at least partially define a cooking chamber having a front opening. When viewed in cross-section a lateral portion or segment of the peripheral skirt has first and second curved sections and a linear section disposed vertically between the first and second curved sections. The bottom cap includes a lower rack-support embossment stamped at least partially in the lateral portion or segment of the peripheral skirt at least partially overlapping said linear section when viewed in cross-section.

In accordance with yet another aspect, there is provided a cooking appliance including an outer cabinet and a muffle disposed within the outer cabinet. The muffle includes a cavity wrapper disposed between and connected to each of a bottom cap and a top cap, wherein the top cap, the bottom cap, and the cavity wrapper collectively define a cooking chamber having a front opening. The top cap includes a top wall, the bottom cap includes a bottom wall, and the cavity wrapper includes a pair of opposing side walls and a rear wall. A door is movably coupled to the outer cabinet to selectively close the front opening of the cooking chamber, and a heating element is disposed within the cooking chamber.

The bottom cap has a pair of opposing lateral skirt portions or segments extending away from respective opposing lateral ends of the bottom wall, wherein each said skirt portion or segment extends toward a respective one of the opposing side walls of the cavity wrapper and is joined thereto via a weld seam.

Each of the opposing lateral skirt portions or segments has, when viewed in cross-section, first and second curved sections and a linear section disposed between the first and second curved sections. Each of the opposing lateral skirt portions or segments has a lower rack-support embossment formed integral therewith at a location vertically beneath the weld seam. Each of the lower rack-support embossments has at least two embossed features extending into a volume of the cooking chamber. Each of the at least two embossed features has a respective contour that is or converges to tangent to the linear section of the respective lateral skirt portion or segment.

DESCRIPTION OF EXAMPLE EMBODIMENTS

Figure 1:
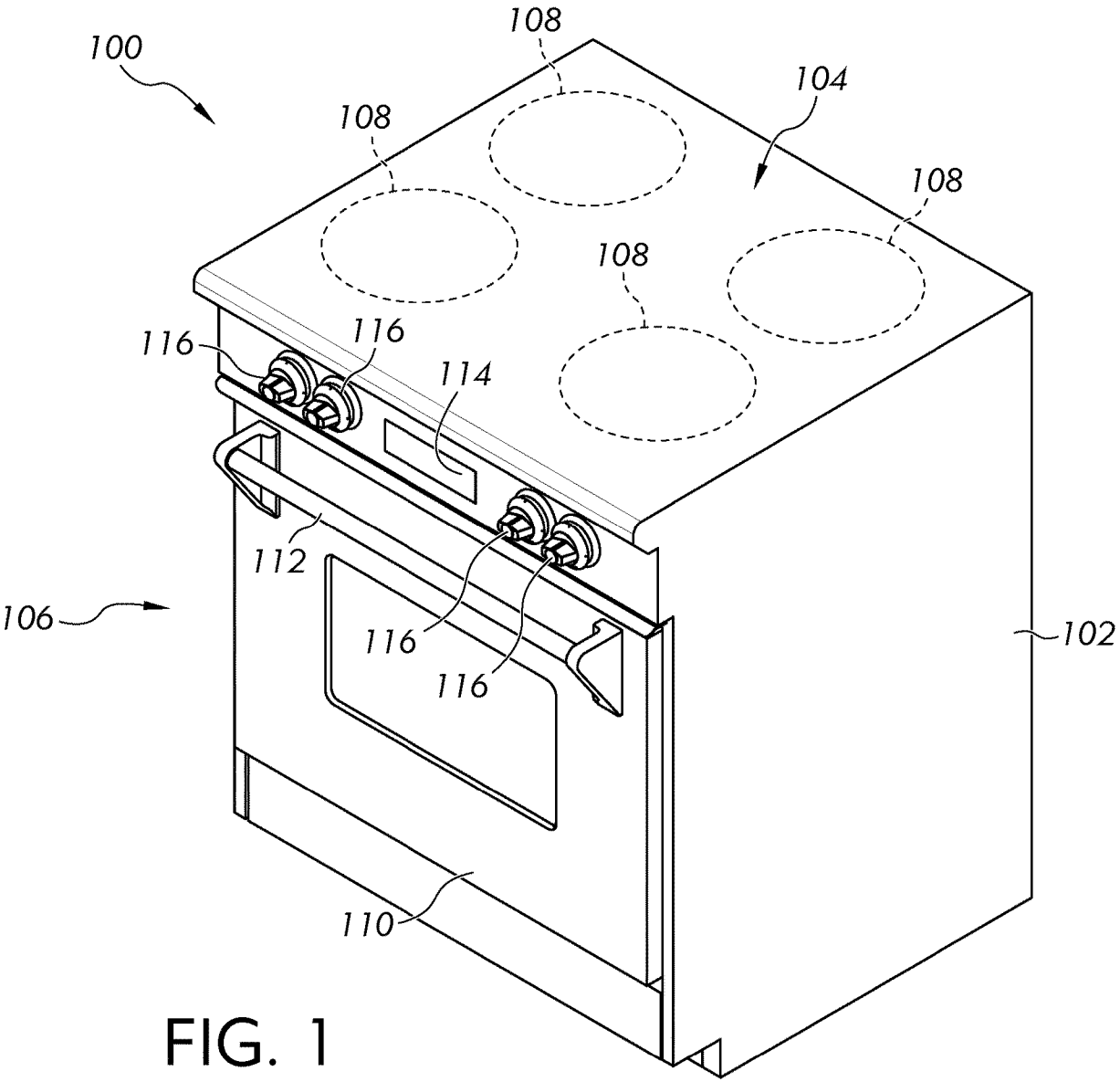
FIG. 1 is a schematic perspective view of a cooking appliance having a cooktop and an oven.

Referring now to the drawings, FIG. 1 depicts a cooking appliance 100 having an outer body 102 that defines an external appearance thereof. Specifically, the outer body 102 can include structural features (e.g., braces, struts, etc., not shown) as well as decorative features (e.g., outer panels adhered to the structural features). Alternatively, where the external panels have been engineered to be structurally robust against external loads, then those panels themselves may be or include the structural features to which other internal components of the appliance 100 are affixed. The cooking appliance 100 can be a domestic appliance configured for in-home use, or an industrial appliance for commercial applications. In the illustrated example, the cooking appliance 100 includes a cooktop 104 and an oven 106. The cooktop 104 is located at a top side of the cooking appliance 100 and includes at least one cooktop heating element 108. Specifically, the cooktop heating element 108 can be a gas burner, an electric resistive coil burner, an electric radiant burner element under glass, an induction element, or any other type of heating element.

The cooking appliance 100 further includes a door 110 pivotably coupled to the front of the appliance and configured to provide selective access to the oven 106. For example, a handle 112 is disposed on an outer surface of the door 110 and enables a user to open the door 110 to permit access to the oven 106. As schematically shown in FIG. 1, a display panel 114 and inputs 116 (e.g., rotatable dials, slidable switches, mechanical buttons, and/or electronic buttons—e.g. touch buttons) can be disposed on a front surface of the outer body 102 (e.g., a front-control appliance). During operation, a user interacts with the inputs 116 to activate/control the cooktop 104 and/or the oven 106. The display panel 114 depicts operational information of the cooking appliance 100 and may even include selectable inputs (e.g., touch-inputs).

While the features disclosed below are described with respect to the aforementioned cooking appliance 100, they are not limited thereto, and other cooking appliances and/or combinations of cooking appliances are contemplated.

Figure 2:
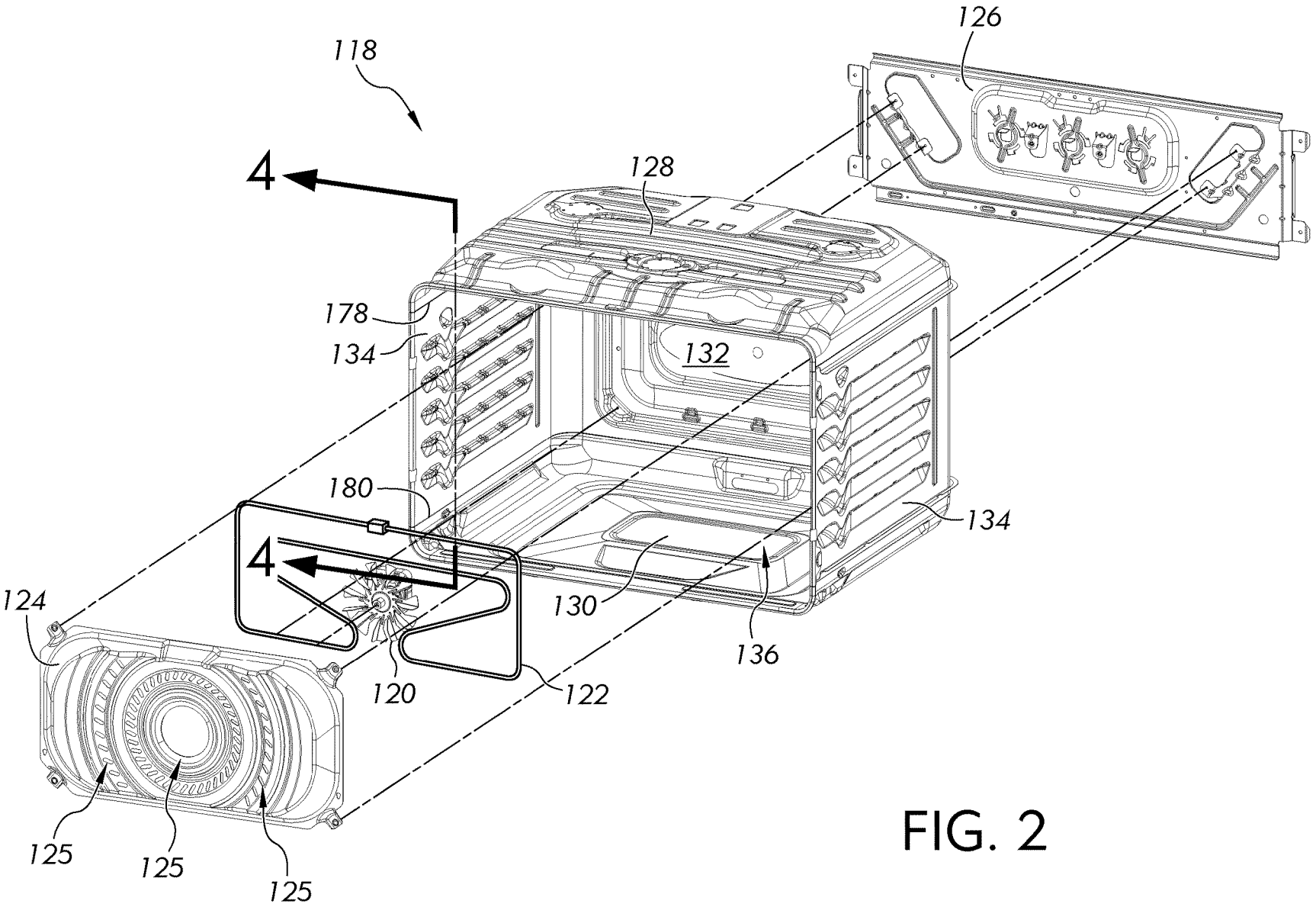
FIG. 2 is an exploded view of select features of the oven of the appliance, including a mounting bracket, a muffle, a convection fan and associated convection heating element, and a convection shroud.

With respect to FIG. 2, selected features of the oven 106 are shown in an exploded view, removed from the outer body 102. The oven 106 includes a muffle 118, a convection fan 120, a convection heating element 122, a convection shroud 124, and a mounting bracket 126. As will be explained further below, the muffle 118 includes a top wall 128, a bottom wall 130, a rear wall 132, and a pair of opposing side walls 134 that collectively define a cooking chamber 136.

The convection fan 120 (when equipped) can be a centrifugal fan that draws air along its axis and redirects the air to exit in a radial direction. Specifically, the convection fan 120 draws air from within a central area of the cooking chamber 136 and redirects said air radially in a direction towards the top wall 128, the bottom wall 130, and the opposing side walls 134. However, it is contemplated that other types of fans which generate different flow patterns can be used. Further, the convection heating element 122 is shown as being a single (continuous) electrically resistive wire having a plurality of bends. However, it is contemplated that a plurality of electrically resistive wires can collectively make up the convection heating element 122, or other heat sources known in the art (e.g., gas) can be used. Alternatively, a convection heating element can be omitted.

The convection shroud 124 in the illustrated embodiment has a substantially rectangular body. However, it is contemplated that the convection shroud 124 (when equipped) can have any geometric shape (e.g., square, circular, oval, etc.). The convection shroud 124 includes one or a plurality of intake openings 125 (i.e., through-holes) that permit air flow to pass therethrough. The convection fan 120, the convection heating element 122, and the convection shroud 124 collectively function to draw air from within the central area of the cooking chamber 136, heat said air, and expel said heated air back towards the central area of the cooking chamber 136. The mounting bracket 126 is used to secure the muffle 118 to the structural elements of the cooking appliance 100 (e.g. to the outer body 102).

Figure 3:
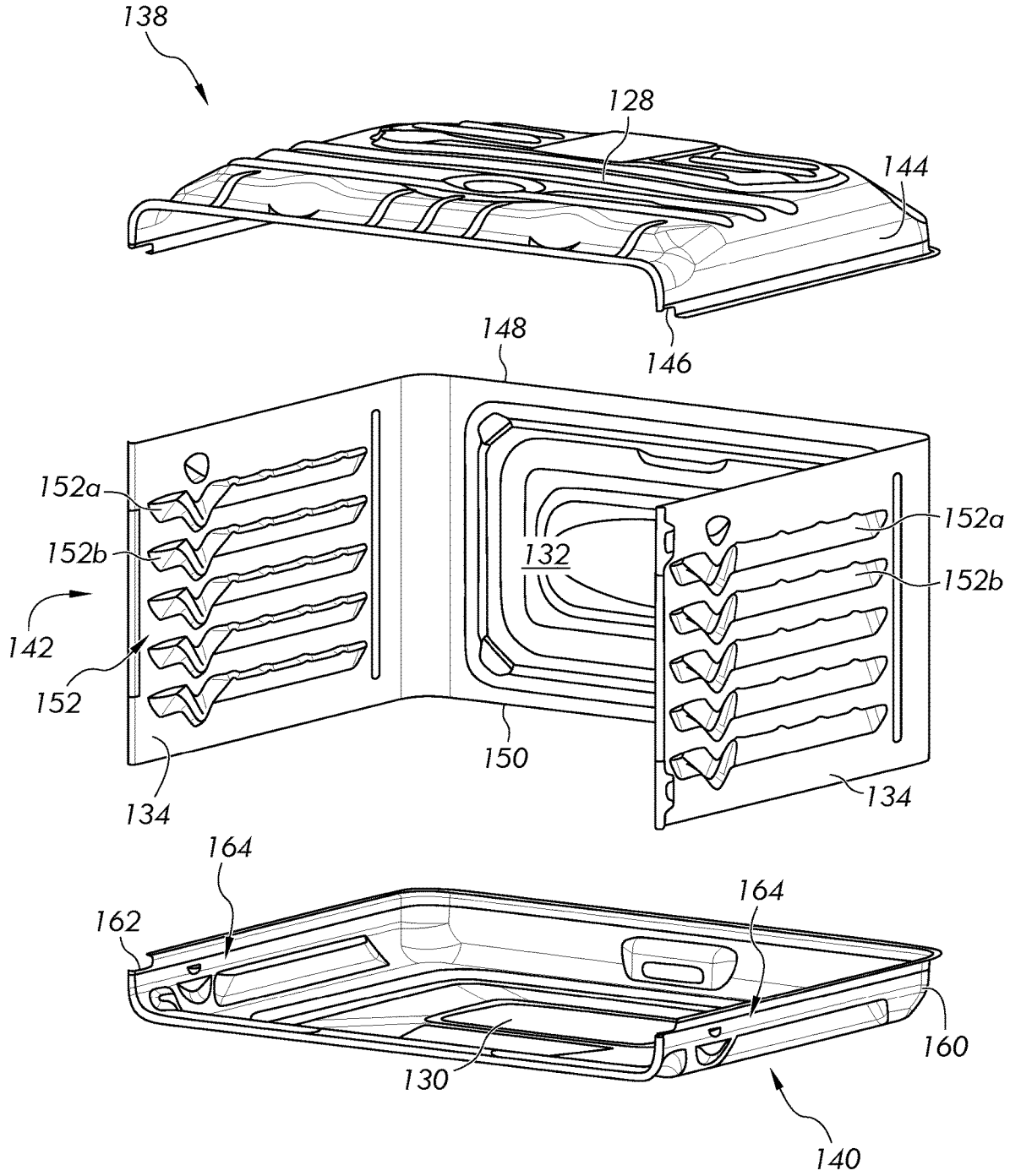
FIG. 3 is an exploded, perspective view of the muffle, including a cavity wrapper, a top cap, and a bottom cap.

FIG. 3 shows the muffle 118 in an exploded view. Prior to assembly, the muffle 118 includes a top cap 138, a bottom cap 140, and a cavity wrapper 142. Each of the top cap 138, the bottom cap 140, and the cavity wrapper 142 preferably is formed from stamped sheet metal, and provided independent of the others. Optionally, these separate components of the muffle 118 can be coated with a ceramic material (e.g., a porcelain or enamel coating), as known in the art.

The top cap 138 includes the top wall 128 that partially defines the cooking chamber 136 (described above), as well as a peripheral skirt 144 extending downward, away from the top wall 128. The peripheral skirt 144 extends substantially perpendicular, downward towards the cavity wrapper 142.

As illustrated, the peripheral skirt 144 typically extends about a periphery of the top wall 128 except along a front portion thereof, corresponding to a front opening of the cooking chamber 136. A top cap edge 146 is provided at a terminal end of the peripheral skirt 144 and substantially conforms to the geometry of a first (upper) terminal edge 148 of the cavity wrapper 142, in order to be efficiently joined thereto (e.g. via welding) as will be described further below. The aforementioned features of the top cap 138 preferably are formed integral with one another during a single manufacturing process, such as stamping. Alternatively, the top cap 138 may be formed via a plurality of successive manufacturing processes/steps (e.g., successive die-stamping and bending steps).

The cavity wrapper 142 includes the rear wall 132 and the opposing side walls 134 that partially define the cooking chamber 136 (described above). Specifically, the cavity wrapper 142 preferably is formed from a single, flat sheet of material (e.g., metal) that is stamped to introduce the desired embossed features and plastically deformed (e.g., via bending) into a "C" shape (when viewed from above) to yield the rear wall 132 and the opposing side walls 134 as a continuous, single sheet of metal. Moreover, the respective corners where each of the opposing side walls 134 meets the rear wall 132 can be curved (as shown) or may form a pointed edge. However, curved corners are preferred because they will be less susceptible to stress fracturing (e.g., from thermal cycling).

The cavity wrapper 142 extends vertically between first (e.g., upper) and second (e.g., lower) terminal edges 148, 150. The first terminal edge 148 preferably is an upper most edge that extends continuously along the rear wall 132 and the opposing side walls 134, whereas the second terminal edge 150 preferably is a lower most edge that extends continuously along the rear wall 132 and the opposing side walls 134. While the depicted embodiment illustrates continuous first and second terminal edges 148, 150, it is contemplated that the first and/or second terminal edges 148, 150 can have discontinuities (e.g., depressions or cut-outs therein at selected locations depending on the mechanical and structural requirements of a particular appliance).

As further shown in FIG. 3, each of the opposing side walls 134 of the cavity wrapper 142 includes a series of embossments 152 formed therein, vertically spaced on the side wall 134 for supporting cooking racks (e.g., cooking rack 165 shown in FIG. 5) at different levels within the cooking chamber 136. Specifically, respective pairs of embossments 152 are arranged on the opposing side walls 134 and extend along the depth of those walls in a direction between the rear wall 132 and the front opening of the cooking chamber 136. Each embossment 152 protrudes into the cooking chamber 136 in order to support lateral edges of cooking racks thereon.

Figure 4:
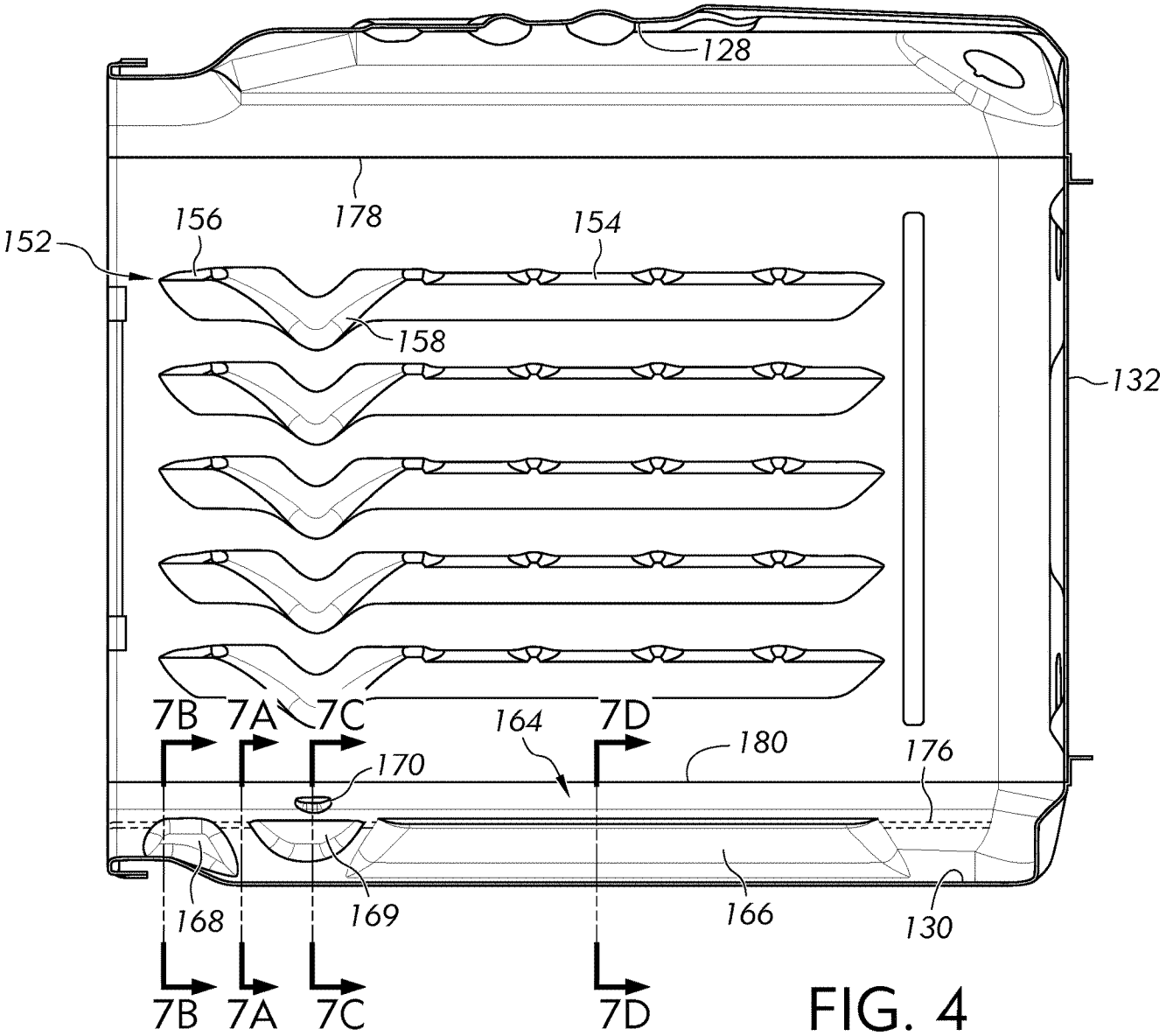
FIG. 4 is a cross-sectional view of the muffle, taken along line 4-4 shown in FIG. 2.

As best shown in FIG. 4, each embossment 152 typically includes a shelf section 154 extending forward from adjacent the rear wall 132, and a front-support section 156 extending rearward from adjacent the front opening of the cooking chamber 136, with a detent section 158 located therebetween. The shelf and front-support sections 154, 156 define an upper surface adapted to accommodate a cooking rack (e.g., cooking rack 165). The detent section 158 can include an elbow portion extending downward from the shelf and front-support sections 154, 156 to a downwardly-pointed apex. Typically, the entire embossment 152 on the side wall 134, including the detent section 158 and the shelf and front-support sections 154, 156 are formed integrally as a single, continuous embossment penetrating laterally into a volume of the cooking chamber 136 from the side wall 134.

Returning to FIG. 3, a first set of embossments 152*a* are formed on the opposing side walls 134, respectively, and are vertically aligned with one another to support a cooking rack extending between them at the corresponding elevation to support a food item for cooking. A second set of embossments 152*b* are formed on the opposing side walls 134, respectively, at a different elevation, vertically below the first set of embossments 152*a*, adapted to support a cooking rack at their corresponding elevation. Further sets of opposing and cooperating embossments may be provided in the opposing side walls 134, as shown. While FIGS. 2-4 depict the opposing side walls 134 having five different sets of embossments, it is contemplated that the opposing side walls 134 may have any number of embossments and sets of embossments. Moreover, although it is shown that each embossment 152 located on a side wall 134 is identical in structure to the other embossments 152, it is contemplated that said embossments 152 may have varying configurations with respect to one another.

With respect to FIG. 3, the bottom cap 140 includes the bottom wall 130 that partially defines the cooking chamber 136 (described above), as well as a peripheral skirt 160 extending upward, away from the bottom wall 130. In particular, the peripheral skirt 160 is substantially perpendicular to the bottom wall 130 and extends vertically upwards. That is, the peripheral skirt 160 extends at an angle of about 90° from the bottom wall 130 (but can extend therefrom at other angles) in a direction away from the bottom wall 130 and towards the top wall 128, in an assembled position (e.g., as shown in FIG. 2).

Similar to the peripheral skirt 144 of the top cap 138, the peripheral skirt 160 of the bottom cap 140 preferably extends about a periphery of the bottom wall 130 except along a front portion thereof, corresponding to the front opening of the cooking chamber 136. Optionally, the peripheral skirt 160 may be provided as discrete skirt segments extending from the bottom wall 130 only at opposing lateral ends thereof, corresponding to the locations of the opposing side walls 134, respectively. The peripheral skirt 160 (or opposing lateral skirt segments) of the bottom cap 140 terminate(s) in a bottom cap edge 162, which substantially conforms to the geometry of the second (lower) terminal edge 150 of the cavity wrapper 142 in order to be efficiently joined thereto (e.g. via welding).

Figure 5:
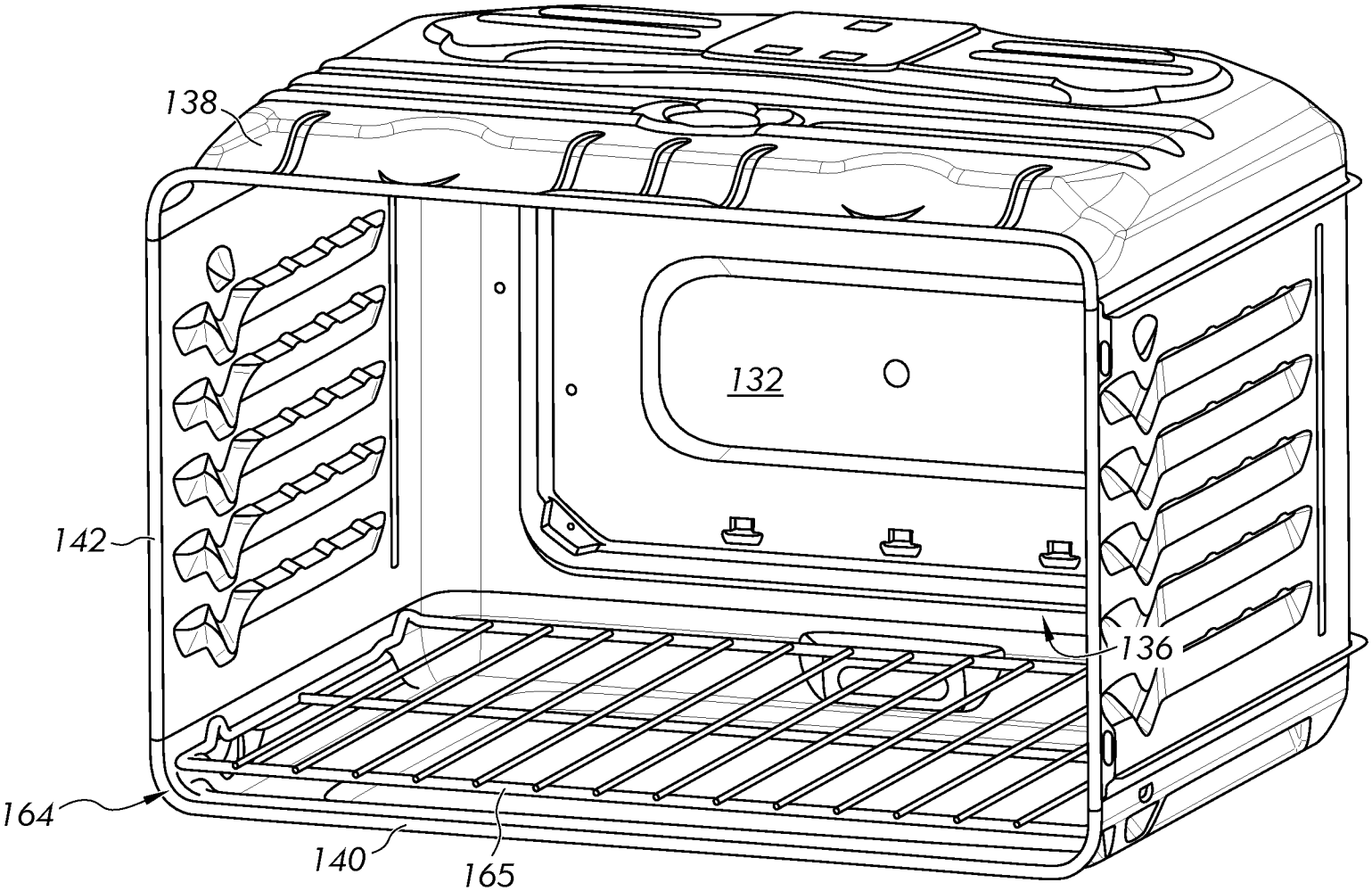
FIG. 5 is a perspective view of the muffle, including a cooking rack supported on lower rack-support embossments.

As shown in FIGS. 3-6, the bottom cap 140 includes a pair of lower rack-support embossments 164 formed therein. The lower rack-support embossments 164 are provided (e.g. stamped) in the opposing lateral portions (or skirt segments) of the peripheral skirt 160, opposing one another and adapted to support a cooking rack 165 therein in a lower portion of the cooking chamber 136 at the corresponding elevation (e.g., as shown in FIG. 5). The aforementioned features of the bottom cap 140 are formed integral with one another, preferably from a single piece of sheet metal (coated or uncoated) as will be further discussed below. Moreover, the above-noted features of the bottom cap 140 can be formed during a single manufacturing process, or via a plurality of successive manufacturing processes/steps (e.g., successive die-stamping and bending steps).

As with the other rack-support embossments 152 stamped in the cavity wrapper 142, each lower rack-support embossment 164 extends along the depth direction (i.e., a direction from the rear wall 132 towards the front opening) of the cooking chamber 136. Further, each lower rack-support embossment 164 protrudes into the cooking chamber 136 in order to support the cooking rack 165 thereon.

Figure 6:
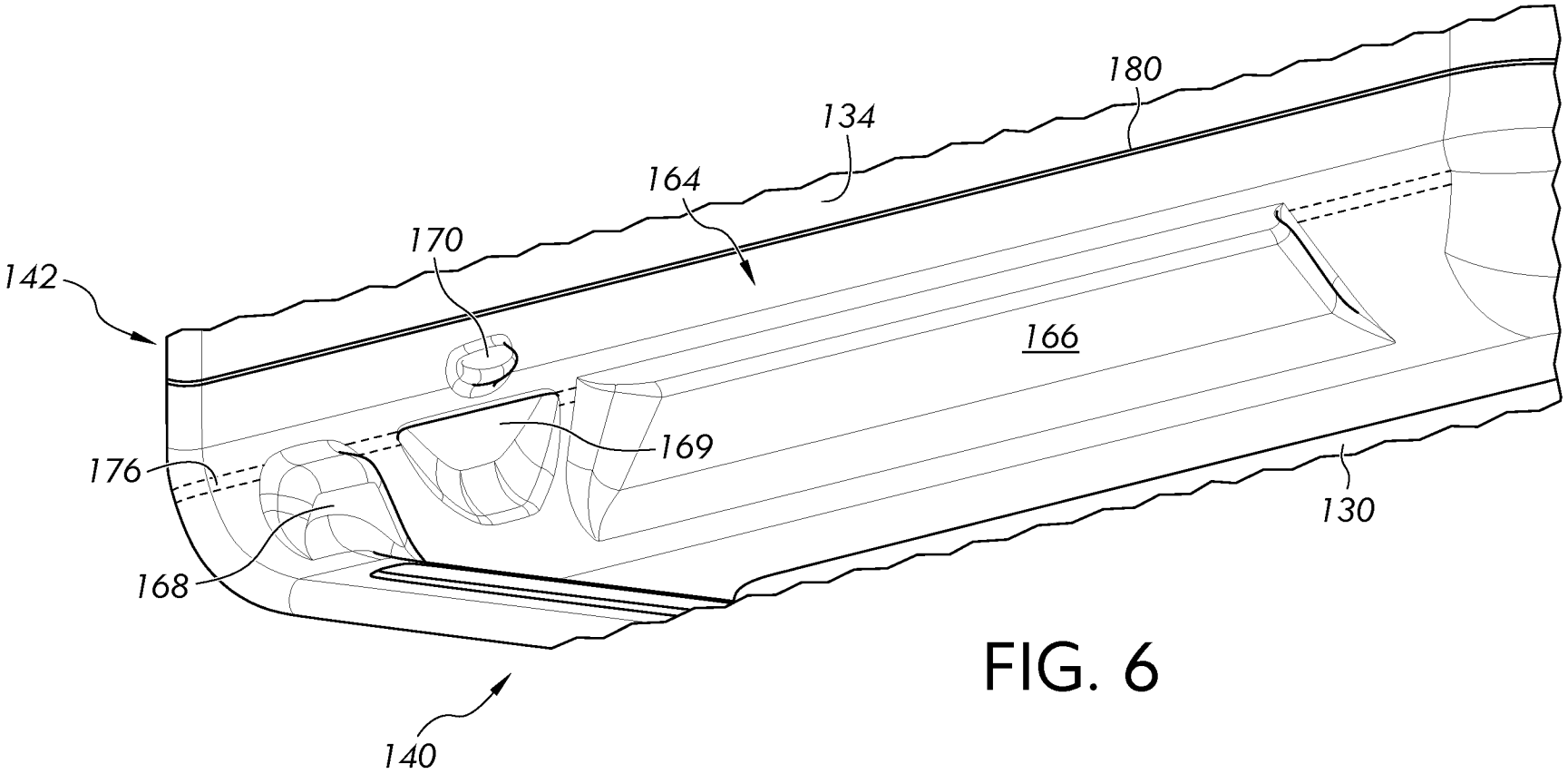
FIG. 6 is an enlarged partial-perspective view of the muffle, depicting one of the lower rack-support embossments.

Referring now to FIGS. 4 and 6, in the illustrated embodiment each lower rack-support embossment 164 includes a shelf portion 166, a front-support portion 168, and a rack stop 170. The shelf and front-support portions 166, 168 are spaced from one another, and together define an upper surface for supporting the cooking rack 165 thereon; analogous to the shelf and front-support sections 154 and 156 of the embossments 152 in the cavity wrapper 142. The shelf portions 166 of each lower rack-support embossment 164 extends along the depth direction of the cooking chamber 136 in the respective lateral portion (or segment) of the peripheral skirt 160 of the bottom cap 140, in order to provide a stable platform or surface on which to support the cooking rack 165 in-use. The front-support portions 168 in each lower rack-support embossment 164 provide further support to the cooking rack 165 at a location adjacent to the front opening of the cooking chamber 136, at a depthwise location opposite the associated shelf portion 166 relative to an intermediate rack stop 170.

The rack stop 170 of each lower rack-support embossment 164 is configured to engage with a structure of the cooking rack 165 to hinder said cooking rack 165 from being inadvertently pulled out past a predetermined degree of withdrawal from the cooking chamber 136 without some further user intervention; such as tilting the cooking rack 165 to eliminate interference with the rack stop 170 for removal thereof. The rack stop 170 can be vertically arranged above the shelf and front-support portions 166, 168 of the associated lower rack-support embossment 164. That is, the rack stop 170 of each lower rack-support embossment 164 can be positioned closer to the bottom cap edge 162 of the bottom cap 140 than the other portions of the lower rack-support embossment 164.

As briefly mentioned above, the lower rack-support embossments 164 preferably are formed integral with the bottom cap 140 of the muffle 118, and more specifically, in or at least partially in the peripheral skirt 160 thereof. As best shown in FIG. 6, each of the shelf and front-support portions 166, 168, and the rack stop 170 protrude from the peripheral skirt 160 and into the volume of the cooking chamber 136. As shown, these embossed features are introduced into a curved sheet-metal part relatively near the bottom cap edge 162, which together with the second (lower) terminal edge 150 of the cavity wrapper 142 will define a seam (i.e., seam 180) for the muffle 118 upon assembly. Traditionally, it can be challenging to introduce stamped/embossed features into sheet metal in such proximity to one another, and particularly to an edge it is desired to preserve as relatively straight, without either or both warping/deflecting that edge and/or introducing undesired internal stresses into the sheet metal as adjacent embossments compete for sheet-metal material from a common pool as they are introduced via stamping.

By comparison, the stamped-in embossments 152 on the opposing side walls 134 of the cavity wrapper 142 are formed in flat sheets and spaced a minimum distance both from one another and from edges of the sheet. Such spacing allows each of the embossments 152 to be introduced and to draw the necessary additional metal material from surrounding regions of the sheet in order to conform to the desired embossed shape, without introducing unacceptable edge deformations or internal sheet-metal stresses (which may cause deformations such as warping, wrinkling or even fracture).

However, as seen in FIG. 6, substantial spacing between embossed features, and from such features and an adjacent edge, are not practical in order to introduce a lower rack-support embossment 164 in the bottom cap 140 beneath the weld seam (i.e., seam 180) that joins that bottom cap 140 and the cavity wrapper 142; which is desirable to maximize the usable space within the volume of the cooking chamber 136. Accordingly, it is desirable to mitigate internal sheet-metal stresses that otherwise might occur when introducing such embossed features in proximity to one another and to a sheet-metal edge. The unique structural arrangement described below aims to align and conform such close-proximity embossed features according to specified geometries so that the competing features are able to draw necessary amounts of material to form each respective embossed shape, while minimizing the introduction of internal stresses that may result in deformation or fracture of the sheet.

The following discussion with respect to FIGS. 6 and 7A-7E relates to a single lower rack-support embossment 164 in one lateral portion (or segment) of the peripheral skirt 160 of the bottom cap 140 (i.e., a portion/segment of the peripheral skirt 160 adjacent to—and when assembled, joined to—one of the opposing side walls 134 at an intermediate seam). It is to be understood that the below-disclosure likewise applies to the opposing lower rack-support embossment 164 provided in the opposing portion/segment of the peripheral skirt 160 located adjacent to the opposing side wall 134.

Figure 7B:
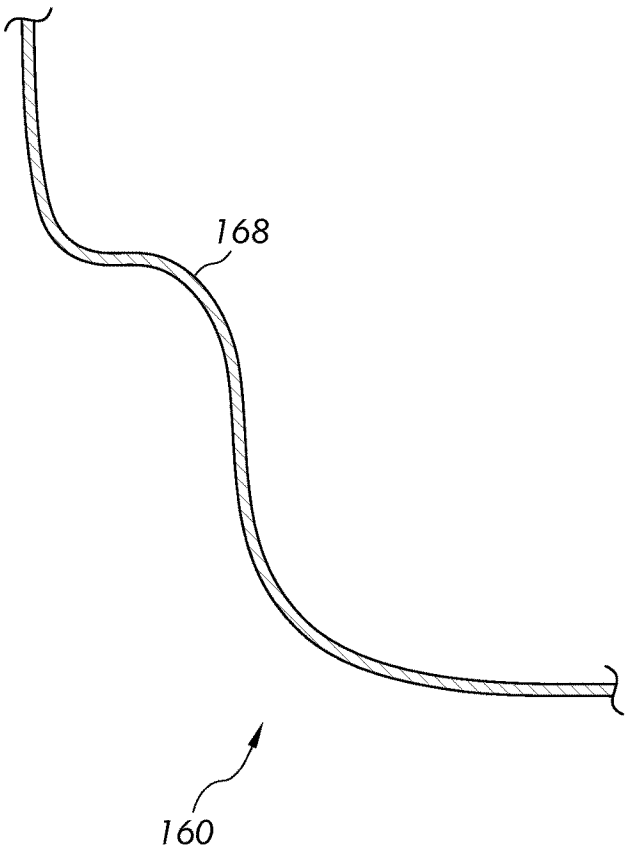
FIG. 7B is a schematic, cross-sectional view of the bottom cap of the muffle, taken along line 7B-7B shown in FIG. 4.
Figure 7A:
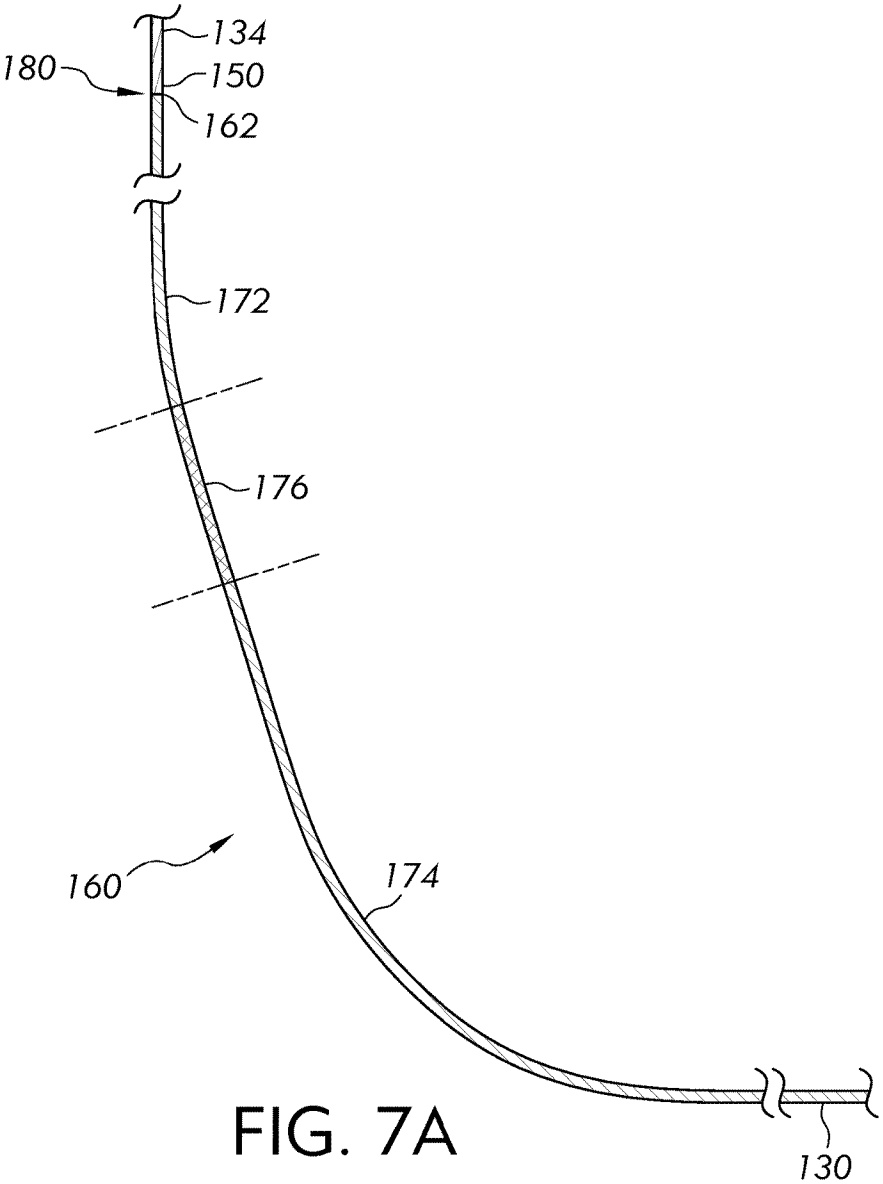
FIG. 7A is a schematic, cross-sectional view of the bottom cap of the muffle, taken along line 7A-7A shown in FIG. 4.

FIG. 7A shows a cross-section of the peripheral skirt 160, taken along the line 7A-7A in FIG. 4. Specifically, the location of the depicted cross-section is interposed between adjacent embossed features, namely the front-support portion 168 of the lower rack-support embossment 164, as well as another ancillary embossment 169 introduced to facilitate insertion and removal of the cooking rack 165 from the cooking chamber 136. The rack stop 170 is disposed above the noted ancillary embossment 169. Notably, the cross-section shown in FIG. 7A represents an un-embossed contour of the bottom cap 140 and its peripheral skirt 160, but located in between adjacent embossed features.

As shown in FIG. 7A, the peripheral skirt 160 includes first and second curved sections 172, 174, with a substantially linear (when shown in cross-section) stress buffer zone 176 disposed between the first and second curved sections 172, 174. As further explained below, the stress buffer zone 176 accumulates drawn stresses within the sheet metal of the bottom cap 140 during manufacturing (e.g., bending, stamping, etc.) when stamping adjacent, close-proximity embossed features. In fact, the stress buffer zone 176 will be a substantially planar strip of the peripheral skirt 160 extending depthwise therein, with which each embossed feature stamped into the peripheral skirt 160 is or becomes tangent on approaching that zone 176 as more fully described below. The first curved section 172 is disposed between the stress buffer zone 176 and the bottom cap edge 162 of the bottom cap 140. The second curved section 174 is disposed between the stress buffer zone 176 and the bottom wall 130. As shown, the first and second curved sections 172, 174 have respective radii of curvature, wherein the radius of curvature of the first curved section 172 preferably is larger than that of the second curved section 174. This configuration results in the stress buffer zone 176 being relatively nearer to the bottom cap edge 162 than to the bottom wall 130, because a lesser degree of curvature is available to transition the peripheral skirt 160 to vertical in order to meet the second (lower) terminal edge 150 of the cavity wrapper 142 along a substantially common plane. However, it is contemplated that the radius of curvature of the first curved section 172 can be smaller than or even equal to that of the second curved section 174 depending on the relative vertical position of the stress buffer zone 176 in the peripheral skirt 160 of the bottom cap 140.

As will be further described, the stress buffer zone 176 provides a region to accumulate and which is believed to better align drawn stresses within the sheet metal of the bottom cap 140 when stamping adjacent, close-proximity embossed features, which all are stamped in the vicinity of, and at least partially overlapping with, the stress buffer zone 176. In this manner, a stress buffer zone 176 as shown and described here has been shown to mitigate unacceptable stresses that otherwise might occur when stamping a plurality of close-proximity embossed features, close to not only one another but also to an adjacent sheet-metal edge, which it is desired to maintain as straight and undeformed as a result of the stamping.

As noted above, the stress buffer zone 176 is substantially planar and extends depthwise along the peripheral skirt 160, separating the first and second curved sections 172, 174, which become tangent thereto at opposing upper and lower ends of the stress buffer zone 176. More specifically, as shown in FIGS. 4 and 6, the stress buffer zone 176 extends along the depth direction from adjacent the rear wall 132 toward the front opening of the cooking chamber 136. Further, the shelf portion 166, the front-support portion 168 and the rack stop 170 of the lower rack-support embossment 164, as well as other optional embossments (e.g. ancillary embossment 169) that may be present in the peripheral skirt 160 are all disposed therein along and at least partially overlapping the stress buffer zone 176.

Figure 7D:
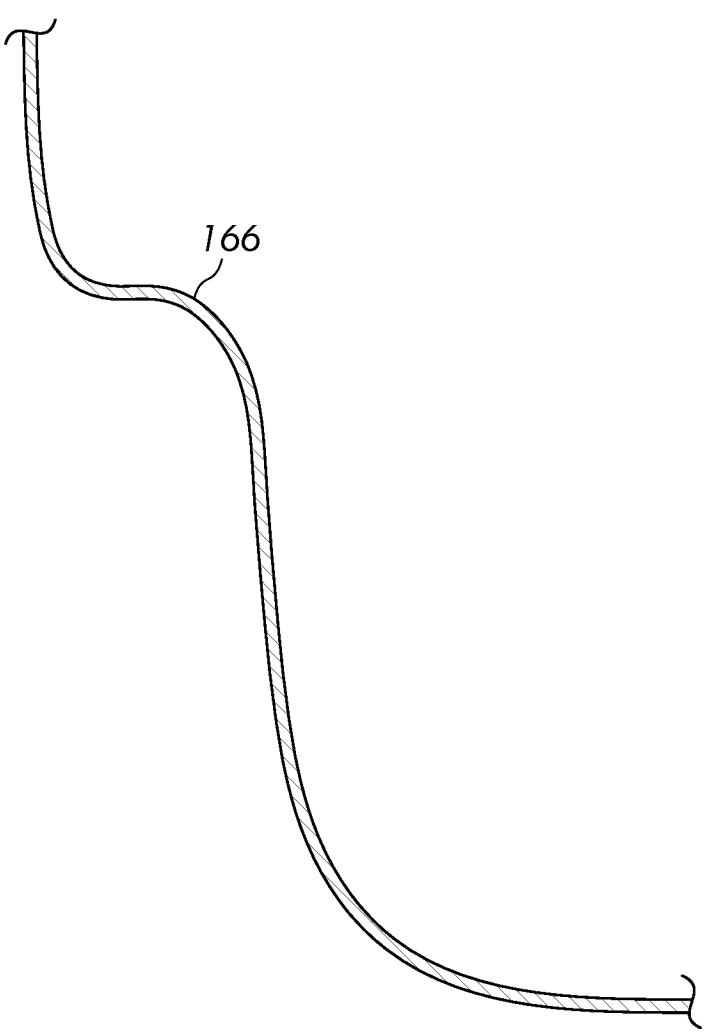
FIG. 7D is a schematic, cross-sectional view of the bottom cap of the muffle, taken along the line 7D-7D.
Figure 7C:
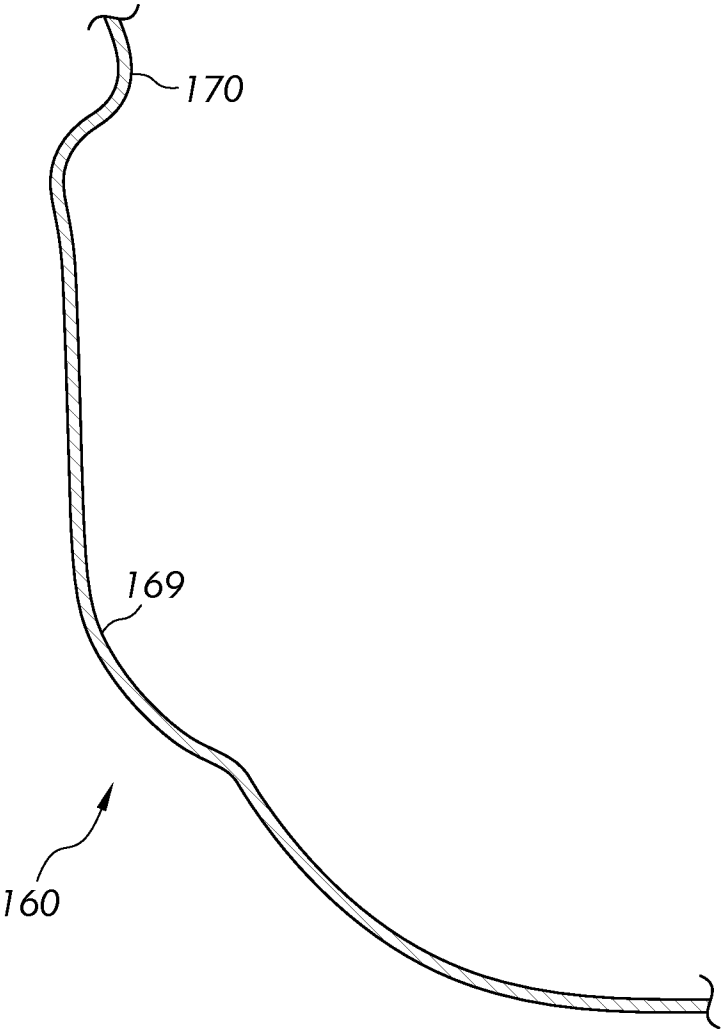
FIG. 7C is a schematic, cross-sectional view of the bottom cap of the muffle, taken along line 7C-7C shown in FIG. 4.

FIG. 7B depicts a cross-section of the peripheral skirt 160 taken along the line 7B-7B in FIG. 4, through the front-support portion 168 of the lower rack-support embossment 164. FIG. 7C depicts a cross-section of the peripheral skirt 160 taken along the line 7C-7C in FIG. 4, through the rack stop 170 (as well as the ancillary embossment 169). FIG. 7D depicts a cross-section of the peripheral skirt 160 taken along the line 7D-7D in FIG. 4, through the shelf portion 166.

Figure 7E:
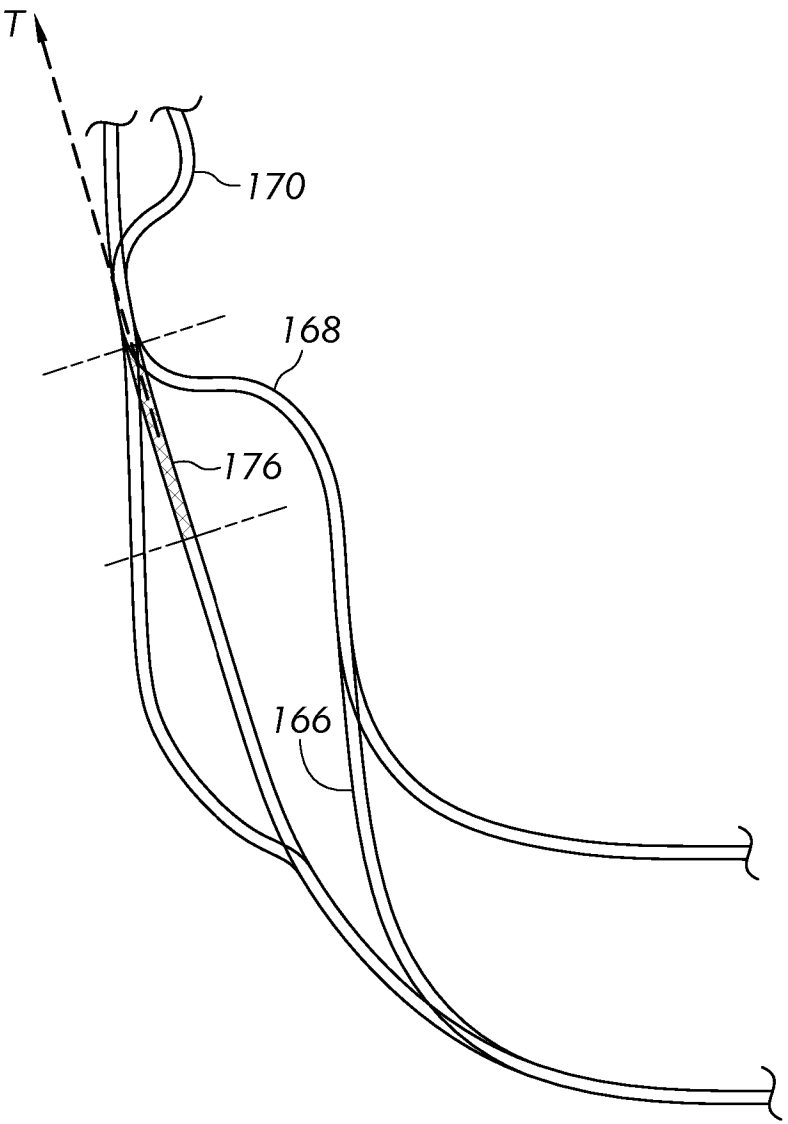
FIG. 7E is a schematic depiction of the cross-sectional views of FIGS. 7A-7D superimposed on one another.

Now with reference to FIG. 7E, the aforementioned cross-sections of the peripheral skirt 160 in FIGS. 7A-7D, which run through different, near-proximity embossed features in the peripheral skirt 160, are shown superimposed on one another. As can be seen, despite having distinct shapes and associated distinct contours when viewed in cross-section, all of the embossed features of the lower-rack support embossment 164 (as well as other near-proximity embossments which may be present in the peripheral skirt 160) converge along a common (or parallel) vector, tangent to the stress buffer zone 176 on reaching or intersecting the stress buffer zone 176. That is, the contours of each of the shelf portion 166, the front-support portion 168 and the rack stop 170 of the lower rack-support embossment 164 converge along or parallel to an imaginary vector T that is tangent to the stress buffer zone 176 (seen in cross-section).

By conforming the contours of close-proximity embossed features to conform to or approach tangency along a common plane (i.e., the stress buffer zone 176) as described, it is believed that as material (e.g., metal) of the peripheral skirt 160 is drawn and stretched during manufacturing to conform to the stamped-in shape of each embossed feature, the material is all drawn along the common vector T, tangent to the stress buffer zone 176. By accumulating the associated drawn-in stresses along such a common vector, the internal flow paths for drawn material within the sheet metal may be similarly accumulated and conformed along that vector, so that they and their associated stresses do not oppose one another on stamping adjacent, near-proximity embossed features. As a result, one reduces introduction of competing internal stresses as the distinct embossed features draw from the same pool of available material (i.e., in competing directions) to accommodate their respective stamped in shapes. This methodology yields common (or parallel) flow paths for the material of the bottom cap 140 in order to accommodate competing stamped-in embossments notwithstanding that those embossments are in near proximity and may otherwise draw material along oblique directions in the absence of parallel tangent vectors all common to the same plane in the stress buffer zone 176.

The accumulation and alignment of internal stresses with respect to the stress buffer zone 176 (during manufacturing) are believed to minimize introduction of misaligned and competing internal stresses that may result in fracturing and/or deformation in the sheet metal. The above-noted methodology also is believed to reduce stresses imparted to the bottom cap edge 162, thereby minimizing its tendency to deform due to the competing stresses that otherwise would be introduced during manufacturing if not accumulated and aligned (as detailed above) to flow along a common (or parallel) vector(s) with respect to the stress buffer zone 176.

Of note, while the stress buffer zone 176 is shown and described above as being planar, it is contemplated that the stress buffer zone 176 can alternatively be curved in cross-section. However, utilizing a curved stress buffer zone 176 would complicate manufacturing because the respective conformations of each of the shelf and front-support portions 166, 168 and the rack stop 170 of the lower rack-support embossment 164 (and any other near-proximity embossed features) would conform to respective vectors that may not be the same on approaching or converging with the stress buffer zone 176, depending on precisely where those embossed features enters convergence with such a curved stress buffer zone 176. By comparison, in most cases it will be simpler and easier to conform all near-proximity embossed features to tangent convergence along a common tangent plane, in terms of both product design and tool-and-die operation during stamping.

Briefly returning to FIG. 3, assembly of the oven muffle 118 will now be described. As detailed above, the top cap 138, the bottom cap 140, and the cavity wrapper 142 preferably are all provided as separate, individual pieces. Thereafter, the top cap 138 is arranged with respect to the cavity wrapper 142 such that the top cap edge 146 of the top cap 138 and the first terminal edge 148 of the cavity wrapper 142 are joined at a first seam 178 (shown e.g., in FIGS. 2 and 4), e.g. by welding. Further, the bottom cap 140 is arranged with respect to the cavity wrapper 142 such that the bottom cap edge 162 of the bottom cap 140 and the second terminal edge 150 of the cavity wrapper 142 are joined at a second seam 180 (shown e.g., in FIGS. 4 and 7A), e.g. also by welding. However, it is contemplated that the first and second seams 178, 180 need not be weld seams. Rather, the top and bottom caps 138 and 140 could be joined to the cavity wrapper 142 via other modalities such as the use of mechanical fasteners, soldering, etc.

As shown best in FIG. 6, when the muffle 118 is assembled, the lower rack-support embossment 164 (i.e., including the shelf and front-support portions 166, 168, and the rack stop 170) is positioned entirely below the second seam 180 where the cavity wrapper 142 and the bottom cap 140 are joined. Accordingly, the cooking rack 165 (as shown in FIG. 5) can be vertically positioned within the cooking chamber 136 at a position that is lower than if the lowest rack-support embossments were positioned in the cavity wrapper 142, above the second seam 180. This renders a greater proportion of the cavity volume available for cooking operations, because food products now can be cooked at a lower position within the cooking chamber 136, nearer the bottom wall 130 than in conventional cooking chambers 136. Said differently, positioning the lower rack-support embossment 164 beneath the second seam 180 provides a lower-most vertical position for the cooking rack 165 beneath the second seam 180, lower than in conventional ovens where embossments 152 are formed only on the opposing side walls 134 of the cavity wrapper 142.

The invention has been described with reference to example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A cooking appliance, comprising:

an outer cabinet;

an oven muffle disposed within the outer cabinet, said oven muffle comprising:

a cavity wrapper joined to a bottom cap at a seam and together therewith at least partially defining a cooking chamber having a front opening; and a lower rack-support embossment formed in the bottom cap below said seam and configured to removably support a cooking rack thereon within the cooking chamber, the lower rack-support embossment including a front-support portion and a shelf portion spaced depthwise from one another; and a door selectively covering the front opening of the cooking chamber.

2. The cooking appliance of claim 1, the cavity wrapper comprising opposing side walls extending vertically from a lower terminal edge, the bottom cap comprising a bottom wall and a peripheral skirt extending upward therefrom to a bottom cap edge, said lower terminal edge of the cavity wrapper and said bottom cap edge being joined to define said seam.

3. The cooking appliance of claim 2, said lower rack-support embossment being at least partially formed in the peripheral skirt of the bottom cap.

4. The cooking appliance of claim 2, further comprising vertically spaced pairs of opposing upper rack-support embossments formed respectively in the opposing side walls of the cavity wrapper, said pairs of upper rack-support embossments being disposed at different vertical locations.

5. The cooking appliance of claim 1, said lower rack-support embossment further comprising a rack stop configured to interfere with withdrawal of the cooking rack past a predetermined degree of withdrawal from the cooking chamber.

6. The cooking appliance of claim 5, said front-support portion configured to support the cooking rack thereon at a location adjacent to said front opening while said shelf portion also supports said rack thereon at a location deeper within the cooking chamber.

7. The cooking appliance of claim 6, each of said shelf portion, said front-support portion and said rack stop being formed as embossed features stamped in said bottom cap, all of said embossed features possessing a contour that, when viewed in cross-section, are tangent to or converge to tangency with a common plane.

8. An oven muffle comprising, a cavity wrapper joined to a bottom cap at a seam and together therewith at least partially defining a cooking chamber having a front opening; and a lower rack-support embossment formed in the bottom cap below said seam and configured to removably support a cooking rack thereon within the cooking chamber, the lower rack-support embossment including a shelf portion and a rack stop, said rack stop being configured to interfere with withdrawal of the cooking rack past a predetermined degree of withdrawal from the cooking chamber, said bottom cap further comprising a stress buffer zone extending depthwise along a lateral portion or segment of a peripheral skirt thereof, each of said shelf portion and said rack stop being formed as embossed features stamped in said bottom cap and at least partially overlapping said stress buffer zone, all of said embossed features possessing a contour that, when viewed in cross-section, are tangent to or converge to tangency with said stress buffer zone.

9. The oven muffle of claim 8, comprising a pair of said lower rack-support embossments stamped in opposing lateral portions or segments of said peripheral skirt, thereby defining a rack-support location within the cooking chamber beneath said seam.

10. The cooking appliance of claim 1, wherein the door is movably coupled to the outer cabinet.

11. An oven muffle, comprising:

a cavity wrapper including a rear wall and opposing side walls; and a bottom cap including a bottom wall and a peripheral skirt extending away from the bottom wall, wherein the cavity wrapper and the bottom cap at least partially define a cooking chamber having a front opening, wherein when viewed in cross-section a lateral portion or segment of the peripheral skirt has first and second curved sections and a linear section disposed vertically between the first and second curved sections, the bottom cap comprising a lower rack-support embossment stamped at least partially in said lateral portion or segment of the peripheral skirt at least partially overlapping said linear section when viewed in cross-section, the first curved section being disposed between the linear section and a seam between the cavity wrapper and the bottom cap, the second curved section being disposed between the linear section and the bottom wall, and the first and second curved sections having different radii of curvature.

12. The oven muffle of claim 1, the peripheral skirt having first and second said lateral portions or segments laterally opposing one another relative to the bottom wall, wherein the first and second lateral portions or segments are joined respectively to the opposing side walls of the cavity wrapper via said seam.

13. The oven muffle of claim 12, further comprising a pair of said lower rack-support embossments located on and formed integral with the first and second lateral portions or segments, respectively of said peripheral skirt.

14. The oven muffle of claim 13, each of the lower rack-support embossments being disposed adjacent to said seam, said seam being a weld seam between the cavity wrapper and the bottom cap.

15. The oven muffle of claim 13, each of the lower rack-support embossments comprising respective shelf portions, front-support portions and rack stops opposing one another, the shelf and front-support portions of each said lower rack-support embossment being spaced depthwise from one another and configured to collectively support a cooking rack thereon in said cooking chamber, the associated rack stop being positioned closer to the front opening of the cooking chamber than the shelf portion and configured to interfere with withdrawal of the cooking rack past a predetermined degree of withdrawal from the cooking chamber.

16. The oven muffle of claim 15, the shelf and front-support portions and the rack stop of each said lower rack-support embossment each having a respective contour that is or converges to tangent with the associated linear section of the peripheral skirt when viewed in cross-section.

17. The oven muffle of claim 11, said lower rack-support embossment having at least two embossed features extending into a volume of the cooking chamber, wherein each of the at least two embossed features has a respective contour that is or converges to tangent to the linear section of the peripheral skirt when viewed in cross-section.

18. The oven muffle of claim 17, the lower rack-support embossment being disposed on the peripheral skirt adjacent to a weld seam between the cavity wrapper and the bottom cap.

19. A cooking appliance, comprising:

an outer cabinet;

a muffle disposed within the outer cabinet, the muffle comprising a cavity wrapper disposed between and connected to each of a bottom cap and a top cap, wherein the top cap, the bottom cap, and the cavity wrapper collectively define a cooking chamber having a front opening, and wherein the top cap includes a top wall, the bottom cap includes a bottom wall, and the cavity wrapper includes a pair of opposing side walls and a rear wall, a door movably coupled to the outer cabinet to selectively close the front opening of the cooking chamber; and a heating element disposed within the cooking chamber, the bottom cap having a pair of opposing lateral skirt portions or segments extending away from respective opposing lateral ends of the bottom wall, each said skirt portion or segment extending towards a respective one of the opposing side walls of the cavity wrapper and joined thereto via a weld seam, each of the opposing lateral skirt portions or segments having, when viewed in cross-section, first and second curved sections and a linear section disposed between the first and second curved sections, each of the opposing lateral skirt portions or segments having a lower rack-support embossment formed integral therewith at a location vertically beneath the weld seam, and each of the lower rack-support embossments having at least two embossed features extending into a volume of the cooking chamber, wherein each of the at least two embossed features has a respective contour that is or converges to tangent to the linear section of the respective lateral skirt portion or segment.

* * * * *